US010864420B2

(12) United States Patent
Elpers et al.

(10) Patent No.: US 10,864,420 B2
(45) Date of Patent: Dec. 15, 2020

(54) BASKETBALL GOAL ASSEMBLY

(71) Applicant: Indian Industries, Inc., Evansville, IN (US)

(72) Inventors: Philip Elpers, Evansville, IN (US); Robert W. Cornell, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 265 days.

(21) Appl. No.: 15/598,758

(22) Filed: May 18, 2017

(65) Prior Publication Data

US 2018/0333625 A1 Nov. 22, 2018

(51) Int. Cl.

| | |
|---|---|
| ***A63B 63/08*** | (2006.01) |
| ***A63B 71/00*** | (2006.01) |
| ***A63B 71/02*** | (2006.01) |

(52) U.S. Cl.

CPC ..... *A63B 63/083* (2013.01); *A63B 71/0036* (2013.01); *A63B 71/023* (2013.01); *A63B 2210/50* (2013.01)

(58) Field of Classification Search

CPC ..... A63B 2225/093; A63B 2210/50; A63B 63/08; A63B 63/083; A63B 63/00; A63B 69/0071; A63B 71/023

See application file for complete search history.

(56) References Cited

U.S. PATENT DOCUMENTS

| | | | | |
|---|---|---|---|---|
| 1,924,811 | A * | 8/1933 | Schulz | A63B 63/083 473/481 |
| 2,120,077 | A * | 6/1938 | Schmidt | B08B 9/0321 285/192 |
| 3,108,803 | A | 10/1963 | Naideth | |
| 3,329,427 | A * | 7/1967 | Bearson | A63B 63/083 473/483 |
| 3,521,917 | A * | 7/1970 | King | E01F 9/635 403/2 |
| 3,544,110 | A * | 12/1970 | Dickinson | A63B 71/023 473/483 |
| 3,586,324 | A | 6/1971 | Bearson | |
| 3,776,549 | A * | 12/1973 | Ganis | A63B 63/083 248/159 |
| 3,802,702 | A | 4/1974 | Pulley | |
| 3,953,029 | A * | 4/1976 | Boyd | A63B 69/0079 473/575 |
| 4,005,860 | A | 2/1977 | Ebstein et al. | |
| 4,198,036 | A * | 4/1980 | O'Neal | B61B 12/06 267/140 |
| 4,762,319 | A * | 8/1988 | Krumholz | A63B 63/08 273/400 |

(Continued)

OTHER PUBLICATIONS

ASTM Standard Designation: F 1882-98 "Standard Specification for Residential Basketball Systems," ASTM International, West Conshohocken, PA.

*Primary Examiner* — Melba Bumgarner
*Assistant Examiner* — Amir A Klayman
(74) *Attorney, Agent, or Firm* — Woodard, Emhardt, Henry, Reeves & Wagner, LLP

(57) ABSTRACT

Aspects of the disclosure include a basketball goal assembly with a vertical support assembly formed with a lower support assembly and an upper support assembly. The basketball goal assembly facilitates packaging, transport, display and installation of the assembly.

13 Claims, 8 Drawing Sheets

(56) References Cited

U.S. PATENT DOCUMENTS 4,781,375 A 11/1988 Nye
4,805,904 A * 2/1989 Nye ..... A63B 63/083 248/284.1
4,825,575 A * 5/1989 Rethke ..... G09F 15/0062 248/533
4,869,501 A * 9/1989 Anastasakis ..... A63B 63/083 248/161
4,934,861 A * 6/1990 Weeks ..... B62D 21/09 403/167
4,940,232 A * 7/1990 Chen ..... A63B 63/083 232/1 B
4,941,661 A * 7/1990 Lykens ..... A63B 63/083 254/98
5,102,128 A * 4/1992 Geise ..... A63B 63/083 473/483
5,211,393 A * 5/1993 Rolffs ..... A63B 63/083 248/284.1
D343,215 S * 1/1994 Grant ..... D21/702
D344,558 S * 2/1994 Livera ..... D21/701
5,316,290 A * 5/1994 Parr ..... A63B 63/083 473/483
5,354,049 A 10/1994 Matherne et al.
5,413,328 A * 5/1995 Glancey ..... A63B 63/00 273/400
5,465,957 A * 11/1995 Schroeder ..... A63B 63/083 248/286.1
5,478,068 A * 12/1995 Schroeder ..... A63B 63/083 473/484
5,503,390 A * 4/1996 Hall ..... A63B 63/083 248/291.1
5,503,493 A * 4/1996 Kato ..... E04H 5/12 403/230
5,570,879 A * 11/1996 Glancey ..... A63B 63/00 273/400
5,570,880 A * 11/1996 Nordgran ..... A63B 63/083 248/218.4
5,738,601 A 4/1998 Hughes
5,897,247 A * 4/1999 Tombs ..... G03G 15/0216 399/168
5,902,197 A * 5/1999 Davis ..... A63B 63/083 473/479
5,913,778 A * 6/1999 Hying ..... E02D 27/42 248/156
5,919,102 A * 7/1999 Smith ..... A63B 63/083 473/484
6,179,733 B1 1/2001 Story
6,254,063 B1 * 7/2001 Rohde ..... E01F 15/0461 256/1
6,264,162 B1 * 7/2001 Barnes ..... E01F 9/635 248/548
6,283,878 B1 * 9/2001 White ..... A63B 63/083 473/479
6,302,811 B1 * 10/2001 Topham ..... A63B 63/083 248/280.11
6,435,306 B2 * 8/2002 Stoneburg ..... E06C 7/44 182/200
D498,800 S 11/2004 Nye et al.
6,824,481 B1 11/2004 Nye et al.
6,932,725 B2 8/2005 Monsen
7,048,655 B2 5/2006 Nye et al.
7,097,574 B2 8/2006 Nye et al.
7,156,246 B2 * 1/2007 Sherrod ..... B66C 23/44 212/180
7,252,605 B2 * 8/2007 Snider ..... A63B 63/008 473/477
D557,759 S * 12/2007 McAllister ..... D21/702
7,320,652 B2 1/2008 Kilpatrick
7,357,738 B2 * 4/2008 White ..... A63B 71/023 473/479
7,587,790 B2 * 9/2009 McCue ..... E01F 15/0469 16/404
7,775,917 B2 * 8/2010 Nye ..... A63B 63/083 248/281.11
8,206,247 B2 6/2012 Elpers
8,303,209 B2 * 11/2012 Lewis ..... E01F 9/635 404/10
8,485,951 B1 * 7/2013 Adams ..... A63B 21/04 224/403
8,555,563 B1 * 10/2013 Wong ..... A01G 17/14 52/117
8,973,332 B2 * 3/2015 Lee ..... E04B 1/24 403/205
9,091,097 B2 * 7/2015 Holmes ..... E04C 3/36
9,542,871 B1 * 1/2017 White ..... G09F 15/0056
10,040,600 B1 * 8/2018 Robbins ..... B65D 19/0073
2002/0010041 A1 * 1/2002 Pearson ..... A63B 63/083 473/479
2003/0171171 A1 * 9/2003 Fair ..... A63B 63/083 473/483
2005/0003910 A1 1/2005 Nye et al.
2005/0215357 A1 9/2005 Guerzini et al.
2006/0183574 A1 8/2006 Stanford et al.
2006/0287141 A1 12/2006 Nye et al.
2007/0010356 A1 * 1/2007 Moller, Jr. ..... A63B 63/083 473/483
2007/0042843 A1 2/2007 Nye et al.
2007/0178994 A1 * 8/2007 White ..... A63B 63/083 473/481
2007/0191148 A1 * 8/2007 Shannon ..... A63B 63/083 473/476
2007/0191151 A1 8/2007 Nye et al.
2008/0039242 A1 2/2008 Nye
2011/0207562 A1 8/2011 Elpers
2013/0037768 A1 * 2/2013 Hayes ..... B66C 23/48 254/327

* cited by examiner

BASKETBALL GOAL ASSEMBLY

FIELD OF THE DISCLOSURE

The present disclosure relates generally to basketball goals, and more particularly to a basketball goal system including a vertical support assembly which can be conveniently packaged and transported in a partially disassembled arrangement and then assembled into a basketball goal for playing the sport of basketball.

BACKGROUND

To play the popular sport of basketball, consumers offer desire to have a basketball goal available at a consumer's home, in a park or in other recreational areas. Portable basketball goal systems have certain advantages and disadvantages compared to permanent basketball goals which are anchored in the ground. For example, in certain cases portable basketball systems are packaged in containers which can be sized to be readily displayed and transported by manufacturers and retailers and which can be readily transported by consumers in typical consumer passenger vehicles such as cars, SUVs and pick-up trucks. However, portable basketball systems have limitations. For example, they can be tipped over if not properly weighted and balanced and/or if exposed to excessive forces during play. Portable basketball system components are also often not as durable as in-ground system components.

In certain circumstances a permanent or in-ground basketball goal is preferred. However, a drawback to many in-ground basketball systems is that it can be difficult for them to be transported and installed by consumers, often requiring professional delivery and installation. As one example, most in-ground basketball systems incorporate a one-piece vertical support member such as a pole. The pole may have a length and weight which is not convenient for a manufacturer, retailer, installer or consumer to transport, display and install. For example a representative pole may be approximately 110" in length. The pole may need to be packaged and/or shipped separately from other system components and may require special handling during transport. Such as trucks or trailers with cargo beds greater than 110".

In some goal systems relatively shorter poles have been used. Using shorter poles improves the ease of display, transport and installation of the pole component, yet as a tradeoff longer and heavier support arms must be used to support the basketball backboard balance at the desired playing height. Lengthening the support arms can create weight, vibration and stress issues. For example, the backboard is usually offset or cantilevered from the support pole. The weight of the backboard assembly and impact forces applied to the backboard assembly are transmitted to the support pole via the support arms. When longer and heavier support arms are used, they act as longer lever arms and increase the vibration and stress forces applied to the pole. The vibration and stress issues in the system can lead to deterioration, breakage and/or lowered performance of the system.

A durable in-ground system where all components can be easily transported and displayed by a manufacturer and retailer and which can be easily transported by a consumer or installer is desirable.

With the increase in online ordering and deliveries and drop-ship sales, it is also desirable to have a durable in-ground basketball goal assembly which can be easily and cost-effectively packaged and delivered by commercial carrier and delivery services.

SUMMARY

Representative embodiments of the present disclosure provide a basketball goal assembly incorporating a vertical support assembly with a lower end anchored to a support surface and with an upper end supporting a backboard assembly. In some embodiments the backboard assembly is adjustable. The vertical support assembly is formed with a lower support assembly and an upper support assembly. The lower support assembly includes a pole section with opposing sides. The upper support assembly includes a pair of spaced apart parallel side bars connected by a bracket. The side bars are arranged on opposing sides of the pole section with a pair of inward surfaces facing the opposing sides of the pole section. Lower ends of the side bars overlap with the upper end of the pole section and the upper support assembly is secured to the lower support assembly.

In certain embodiments, mounting tubes extends through the pole section and define aligned pairs of mounting points. In some embodiments, the mounting tubes have opposing ends which protrude from the pole section so that the side bar inward surfaces contact the protruding ends of the respective mounting tubes. Correspondingly, the protruding ends define a gap spacing the side bar inward surfaces apart from the pole section sides.

In some embodiments, the bracket in the upper support assembly is offset to one side of the side bars, for example upward or rearward. The bracket may be a planar plate spanning the rear sides of the side bars and the distance separating them.

In further embodiments, the components of a basketball goal assembly can, in a partially assembled state, be packaged in a container in a manner which facilitates shipping, storage and transport. The container may be sized and shaped to hold the majority of the components of the basketball goal assembly. In some embodiments, a nest area defined by the upper support assembly allows the upper support assembly to be arranged with assembly components, such as an extension cylinder, support arm or frame portions or a portion of the lower support assembly, received within the nested volume as packaged. This may facilitate packing the assembly in a container with minimal height, length and width. Accordingly, the container may require reduced space during shipment and storage, and may optionally be placed completely in the cargo area of and transported by a consumer passenger vehicle or commercial carrier delivery vehicle.

Further objects, features and advantages of the present disclosure shall become apparent from the detailed drawings and descriptions provided herein. Each embodiment described herein is not intended to address every object described herein, and each embodiment does not include each feature described. Some or all of these features may be present in the corresponding independent or dependent claims, but should not be construed to be a limitation unless expressly recited in a particular claim.

DETAILED DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the invention relates.

Representative embodiments of the present disclosure provide a basketball goal assembly incorporating a vertical support assembly with a lower end anchored to a support surface and with an upper end supporting a backboard assembly. In some embodiments the backboard assembly is adjustable. The vertical support assembly is formed with a lower support assembly and an upper support assembly. The lower support assembly includes a pole section with opposing sides. The upper support assembly includes a pair of spaced apart parallel side bars connected by a bracket. The side bars are arranged on opposing sides of the pole section with a pair of inward surfaces facing the opposing sides of the pole section. Lower ends of the side bars overlap with the upper end of the pole section, and the upper support assembly is secured to the lower support assembly.

In certain embodiments, mounting tubes extend through the pole section and define aligned pairs of mounting points. In some embodiments, the mounting tubes have opposing ends which protrude from the pole section so that the side bar inward surfaces contact the protruding ends of the respective mounting tubes. Correspondingly, the protruding ends define a gap spacing the side bar inward surfaces apart from the pole section sides.

In some embodiments, the bracket in the upper support assembly is offset to one side of the side bars, for example upward or rearward. The bracket may be a planar plate spanning the rear sides of the side bars and the distance separating them.

In further embodiments, the components of a basketball goal assembly can, in a partially assembled state, be packaged in a container in a manner which facilitates shipping, storage and transport. The container may be sized and shaped to hold the majority of the components of the basketball goal assembly. In some embodiments, a nest area defined by the upper support assembly allows the upper support assembly to be arranged with assembly components, such as an extension cylinder, support arms, frame portions or a portion of the lower support assembly, received within the nested volume as packaged. This may facilitate packing the assembly in a container with minimal height, length and width. Accordingly, the container may require reduced space during shipment and storage, and may optionally be placed completely in the cargo area of and transported by a consumer passenger vehicle or common carrier delivery vehicle.

Figure 1:
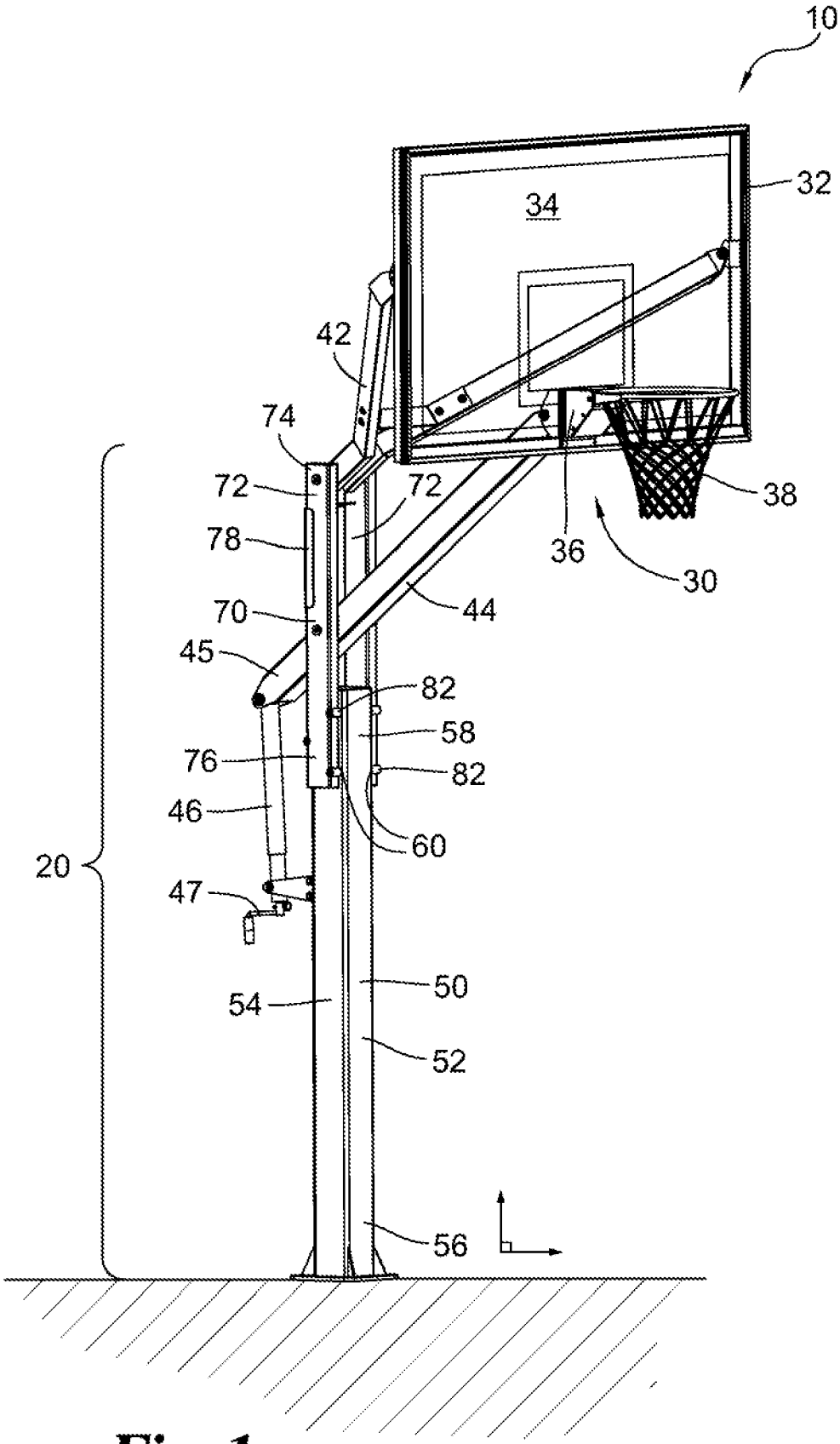
FIG. 1 is a perspective view of a basketball goal assembly according to one embodiment.
Figure 2:
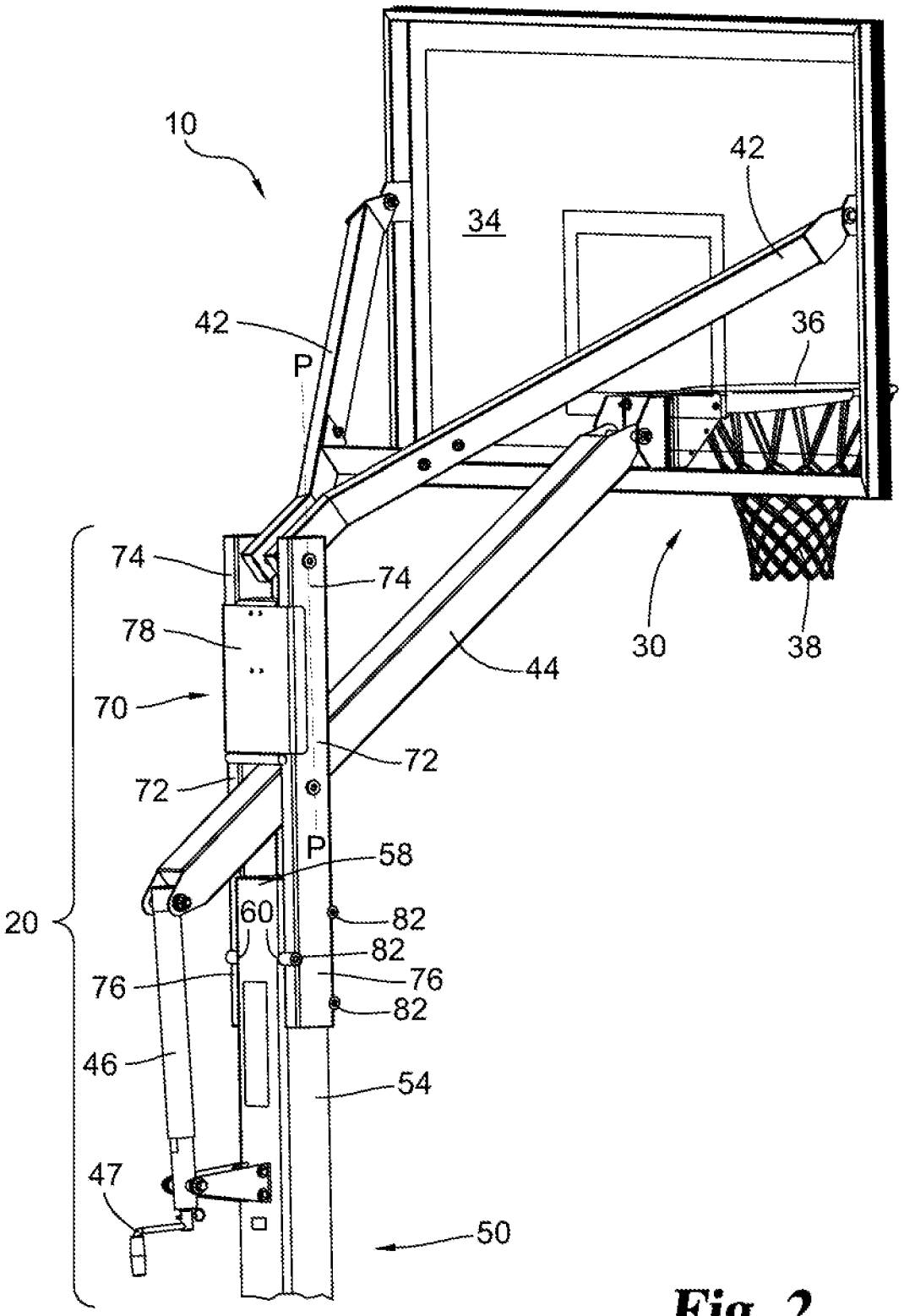
FIG. 2 is a rear perspective view of portions of the assembly of FIG. 1.
Figure 3:
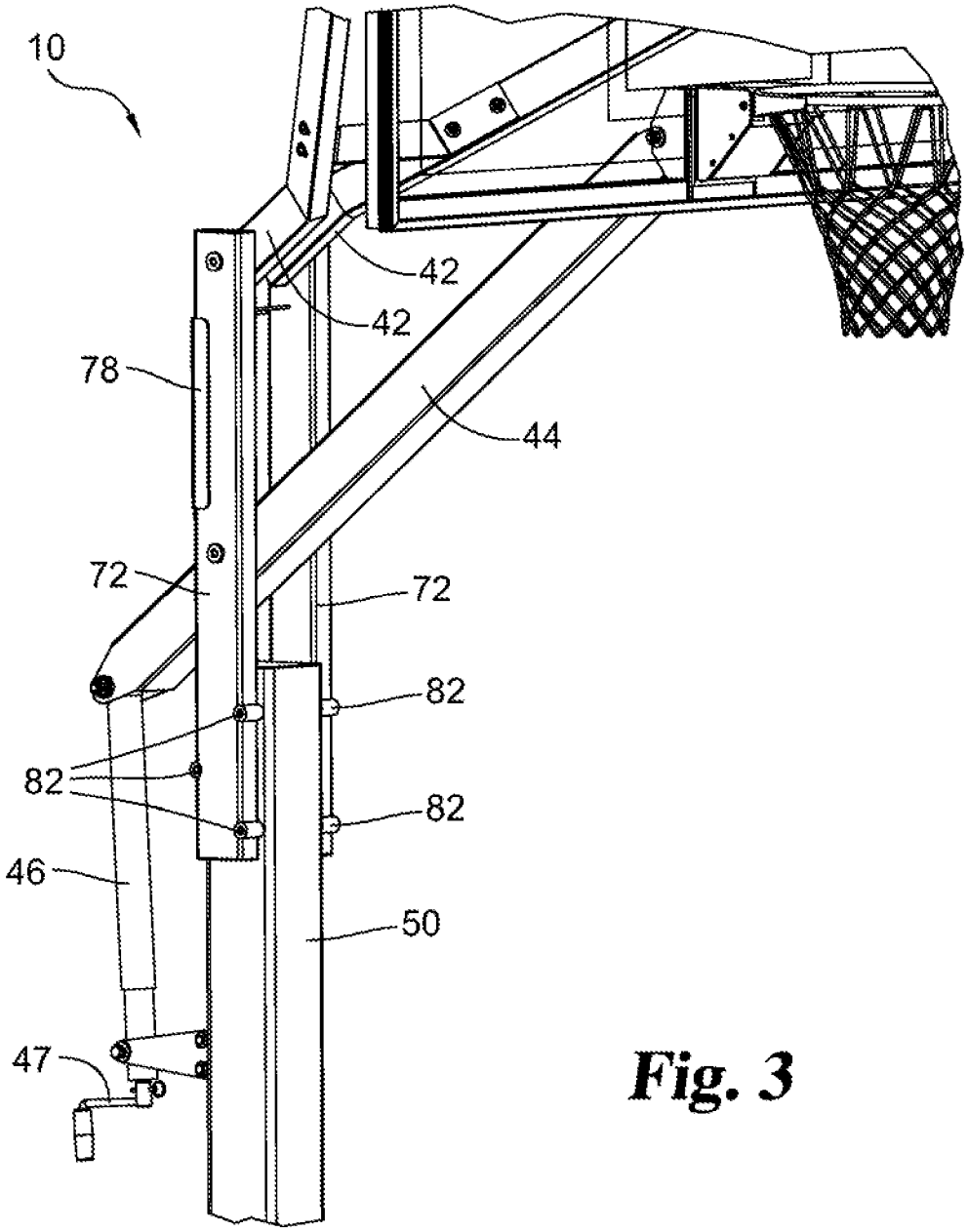
FIG. 3 is a front perspective view of portions of the assembly of FIG. 1.

Illustrated in FIGS. 1-3 is a representative example of a basketball goal assembly 10 according to principles of the disclosure. The illustrated example is not intended to be limiting. Basketball goal assembly 10 includes a vertical support assembly 20. The support assembly 20 is vertically oriented at approximately 90 degrees to the support surface, or alternately may be angled, and supports a backboard perpendicular to and above a playing surface. Basketball goal assembly 10 also includes a representative backboard assembly 30 including a frame 32, a planar backboard 34, a rim or hoop 36 and optionally a net 38. Hoop 38 is attached on a forward side of backboard 34 near the lower edge. The hoop side of the backboard is referred to as the forward side herein, and the direction toward behind the backboard is referred to as rearward. Directional references are for ease of illustration and are not intended to be limiting.

As illustrated, backboard assembly 30 may be adjustable in height relative to support assembly 20. In the illustrated embodiment, a pair of upper support arms 42 and a lower support arm 44 extend from support assembly 20 to backboard assembly 30. Alternately a pair of lower support arms and/or a single upper support arms can be used, with appropriate bracing and connections to the backboard. The upper and lower support arms are pivotally mounted to both the support assembly and the backboard assembly and form an adjustable parallelogram arrangement when viewed from the side. Backboard assembly 30 is supported by the parallelogram structure. The parallelogram is deformable to raise and lower the backboard assembly 30 in relation to support assembly 20. The parallelogram arrangement enables backboard 34 to be raised and lowered while maintaining it as vertical relative to the playing surface, typically parallel to support assembly 20 or a vertical axis P-P through mounting points on the support assembly. In the depicted embodiment, the lower support arm 44 includes a rear extension portion or lever arm 45 extending rearward from the parallelogram which can be used to control the rotation of the parallelogram structure. Stops preferably are provided on the support assembly 20 as a safety device to limit the upward and downward travel of backboard assembly 30. In alternate embodiments, basketball goal assembly 10 may incorporate other adjustment arrangements or can be non-adjustable.

In the illustrated example, an adjustment mechanism is provided using an expansion and retraction cylinder, for example telescoping cylinder 46 controlled with crank handle 47. The telescoping cylinder 46 is pivotally attached to the rear portion of support assembly 20 and to lever arm 45. Crank handle 47 may be detachable.

In greater detail, vertical support assembly 20 includes a lower support assembly 50 and an upper support assembly 70. Lower support assembly 50 and upper support assembly 70 can be transported as separate sub-assemblies and then combined to form the assembled vertical support assembly 20.

Figure 4:
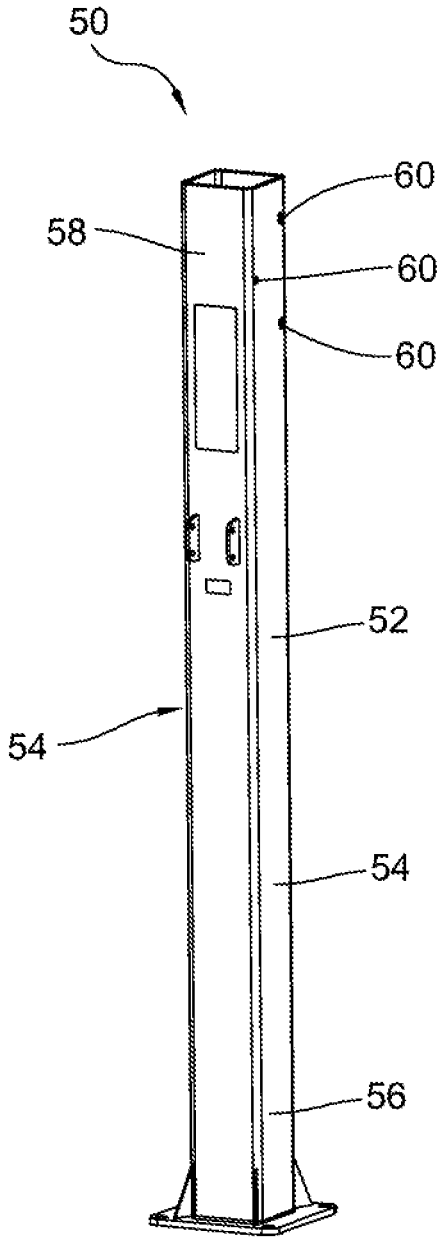
FIG. 4 is a perspective view of the lower support assembly of the assembly of FIG. 1.
Figure 5:
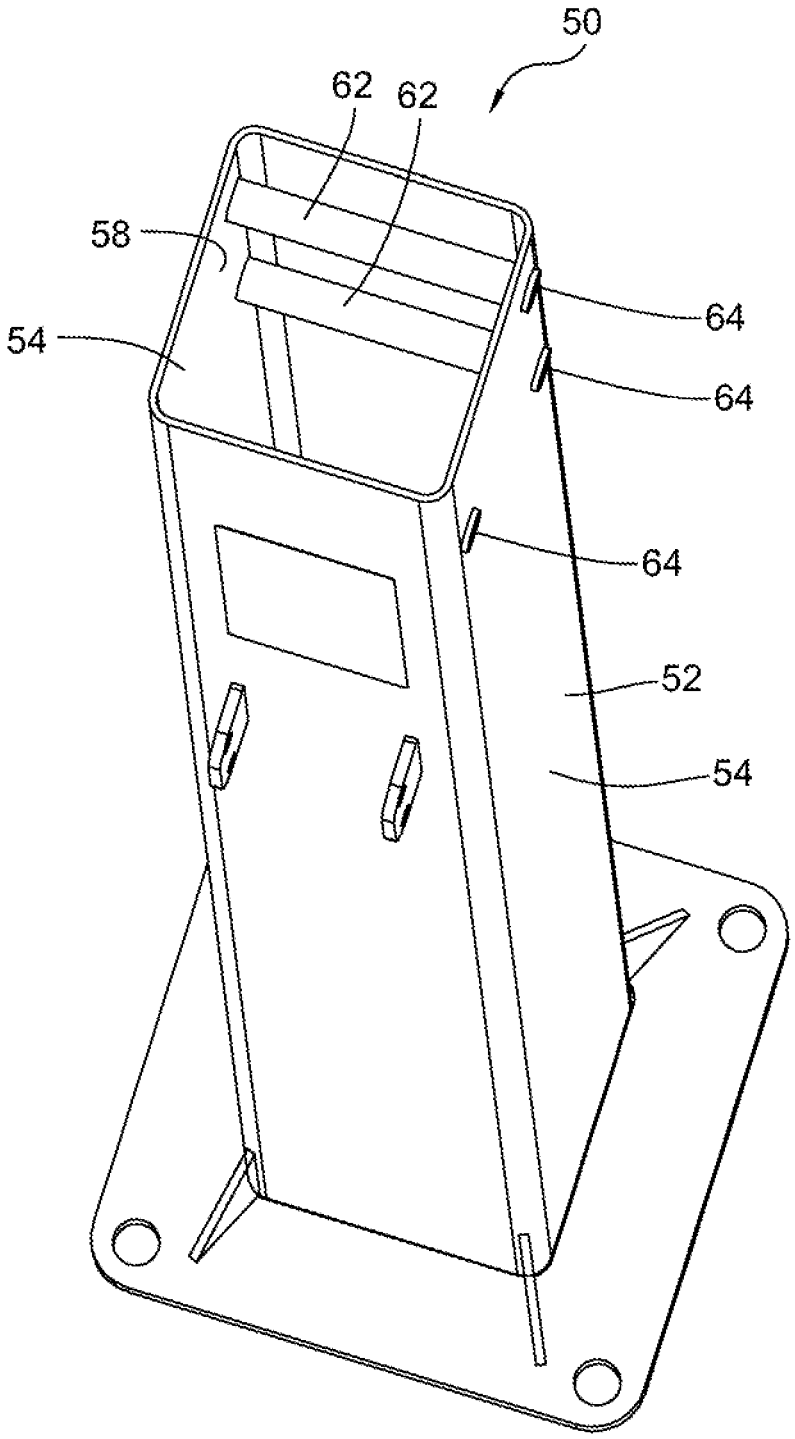
FIG. 5 is a downward perspective view of the pole portion of the lower support assembly of FIG. 4.

Illustrated in detail in FIGS. 4-5, lower support assembly 50 includes a pole section 52. Pole section 52 defines a pair of opposing sidewalls 54 and extends from a base end 56 to an upper end 60. Base end 56 is configured to be mounted as an in-ground system, for example by anchoring base end 56 via mounting flanges to an in-ground anchor of the support surface. Preferably pole section 52 is hollow. Pole section 52 is illustrated with a square cross-section. Alternate cross-sections, such as a round cross-section, can be used in other embodiments. A pair of flanges for mounting telescoping cylinder 46 extend from the rear side of pole section 52. An upper edge of pole section 52 may form one of the safety stops limiting movement of support arm 44 in assembled goal 10. Optionally, a cover 59 (shown in FIG. 7) may close the upper end of pole section 52. Cover 59 may be permanent or removable.

Adjacent upper end 58 are a series of mounting points 60. As illustrated, three mounting points 60 are defined in each side wall 54. The illustrated mounting points 60 are offset in a triangular arrangement with two points adjacent the forward side and one point adjacent the rearward side of pole section 52. In alternate embodiments, a different number of mounting points and/or mounting points in different locations may be used. Mounting points 60 are arranged as aligned pairs defined on opposing sidewalls 54 of pole section 52.

Figure 7:
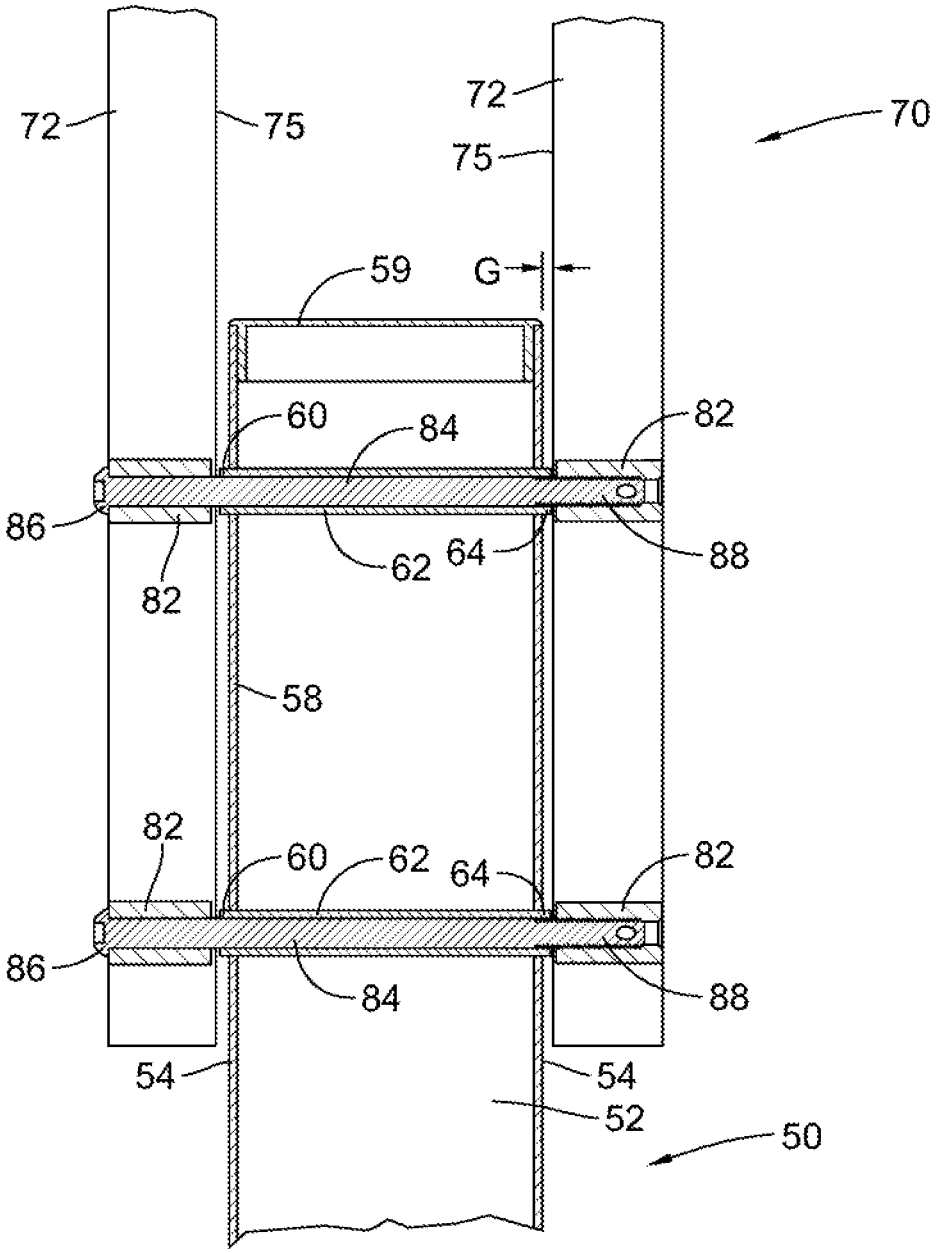
FIG. 7 is a cross-sectional view of a connection of the lower support assembly of FIG. 4 to the upper support assembly of FIG. 6.

As seen most clearly in FIGS. 5 & 7, lower support assembly 50 includes mounting tubes 62 arranged and extending between each pair of aligned mounting points 60 on opposing side walls 54. Mounting tubes 62 extend across the interior of pole section 52. As illustrated, three mounting tubes are parallel yet offset in a triangular arrangement. Mounting tubes 62 may be hollow along their length and configured to allow bolts 84 to be advanced through the tubes. The length of mounting tubes 62 is selected to have ends 64 which slightly protrude from the respective side walls 54. Mounting tubes 62 may be secured in place to pole section 52, for example by welding.

Figure 6:
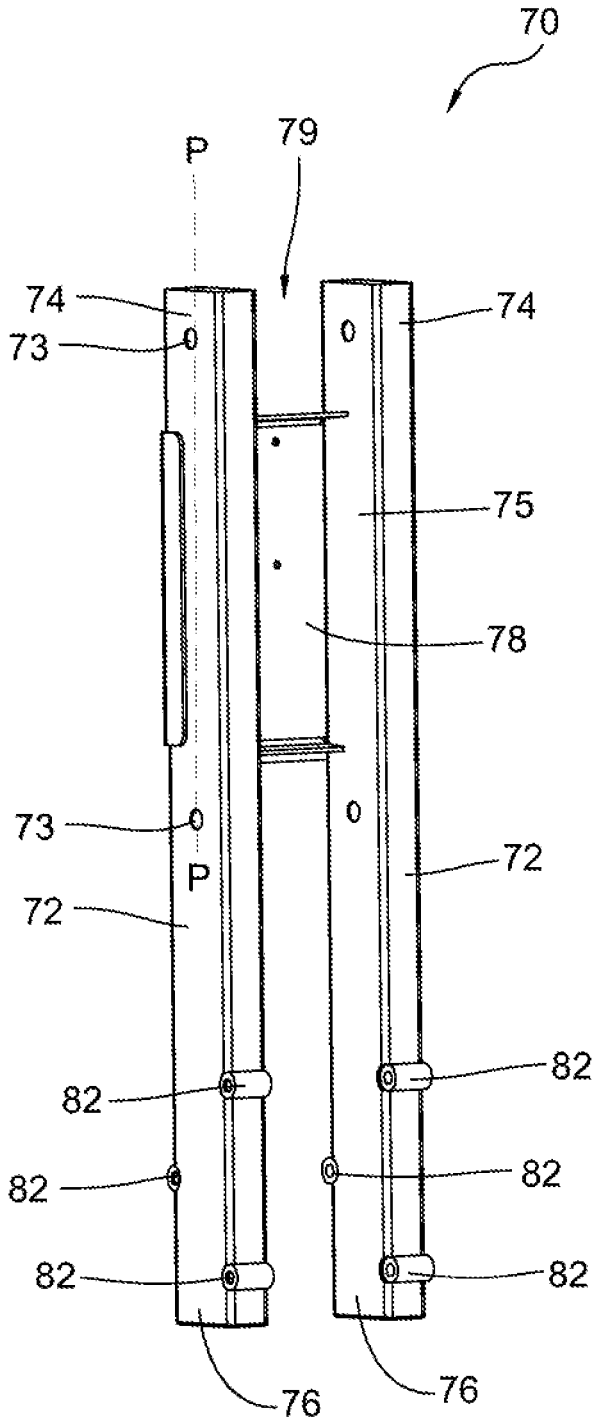
FIG. 6 is a perspective view of the upper support assembly of the assembly of FIG. 1.

Upper support assembly 70 is illustrated in detail in FIG. 6. Upper support assembly 70 includes a pair of parallel side bars 72, which are arranged vertically when goal 10 is assembled. Side bars 72 define upper ends 74 and lower ends 76. As illustrated side bars 72 each have a rectangular cross-section with the shorter rectangular sides forming front and rear sides of the side bars. Side bars 72 define a pair of opposing inward facing surfaces 75. Pivot points 73 define passages through the side walls of side bars 72. When assembled, the support arms 42, 44 are arranged between the side bars 72. Fasteners extend through pivot points 73 to pivotally mount support arms 42, 44 to upper support assembly 70. Pivot points 73 define a vertical axis P-P which is parallel to backboard 34 and forms a side of the parallelogram shape in goal 10. Axis P-P may or may not be parallel to the axis of the side bars in other embodiments.

A bracket 78 extends between and connects side bars 72, for example forming a capital "H" profile. Upper support assembly 70 is formed as a rigid assembly, for example with bracket 78 welded to side bars 27. Bracket 78 is configured to be rigidly assembled with side bars 72 to limit torque, bending or flexing of the assembly. Bracket 78 may be offset toward the upper ends 74 of side bars 72. Bracket 78 may also be offset to one side of side bars 72, for example bracket 78 is illustrated offset to the rearward side of side bars 72.

In the illustrated embodiment, bracket 78 is formed as a planar plate spanning the rear sides of side bars 72 and the distance separating them. Side edges of bracket 78 may be bent to form flanges extending forward along the outward sides of side bars 72. Portions of the upper and lower edges of bracket 78 may be bent forward between side bars 72. A lower edge of bracket 78 may form one of the safety stops limiting movement of support arm 44 in assembled goal 10.

A series of mounting locations are defined adjacent to the lower ends 76 of side bars 72, for example by a series of bushings 82. The arrangement of the mounting locations is placed to be aligned with mounting points 60 in the lower support assembly. The illustrated bushings 82 are offset in a triangular arrangement with two bushings adjacent the forward side and one adjacent the rearward side of each side bar 72. In alternate embodiments, a different number of bushings and mounting points and/or different locations may be used. Bushings 82 are arranged as co-axially aligned pairs on opposing side bars 72. At least one bushing in each pair may be internally threaded. Bushings 82 can be formed integrally with side bars 72 or mounted to the side bars, for example by welding.

When assembling goal 10, upper support assembly 70 is stacked and secured to lower support assembly 50 to create the total height of support assembly 20. As stacked, lower ends 76 of the side bars 72 overlap the upper end 58 of pole section 52. As representative dimensions, the lower support assembly may have a height of approximately 78 inches and the upper support assembly may have a height of approximately 43 inches. They partially overlap when stacked and form an aggregate height of approximately 108 inches. The stacking and assembly can be done before or after lower support assembly 50 is anchored to the ground.

A cross-section illustrating a connection arrangement between upper support assembly 70 and lower support assembly 50 is illustrated in FIG. 7. Steps for assembling upper support assembly 70 to lower support assembly 50 include arranging upper end 58 of pole section 52 between side bars 72 so that the opposing pair of inward surfaces 75 are arranged facing opposing side walls 54 of the pole section. More precisely, the mounting locations such as bushings 82 are aligned with corresponding mounting points 60 and mounting tubes 62. For each mounting location, a distal end 88 of a fastener, such as a bolt 84, is advanced through one bushing 82 and the corresponding side bar 72. As the fastener is further advanced the distal end 88 passes through the lower support assembly, namely a first mounting point 60, then the interior passage of a mounting tube 62 and then through a second mounting point 60. The fastener end then exits the lower support assembly and engages the second bushing 82 of the aligned pair. In one example, the distal end 88 of fastener 84 may be threaded and engages internal threads of the second bushing 82. Each bolt 84 may have a proximal cap end 86 which can be used to apply torque to the bolt and which also helps to apply a clamping force allowing the fastener to tighten and pull the side bars 72 towards each other. In an alternate arrangement, one fastener can be used with each mounting point, for example a pair of bolts each having a length extending inward through a bushing and into a mounting tube. In this arrangement, the mounting tube would include threaded internal portions to engage the distal bolt ends.

As further illustrated in FIG. 7, in certain embodiments the side bar inward surfaces 75 (including bushings 82) abut and contact the protruding ends 64 of the respective mounting tubes 62 in each mounting point. This spaces inward surfaces 75 apart from the side walls 54 of the pole section, creating a small gap G. Correspondingly the clamping force applied when the side bars 72 are pulled together is applied along the longitudinal length of mounting tubes 62 and is not directly applied to the pole side walls 54.

Once the vertical support assembly 20 has been put together, support arms 42, 44 are pivotally mounted to the respective pivot points, typically between side bars 72. Adjustment cylinder 46 is mounted between vertical support assembly and lever 45, and backboard assembly 30 is mounted to the forward ends of support arms 42, 44. The use of appropriate fasteners and order of assembly of various components such as the cylinder and backboard assembly is conventional and will be understood by those of skill in the art.

Figure 8:
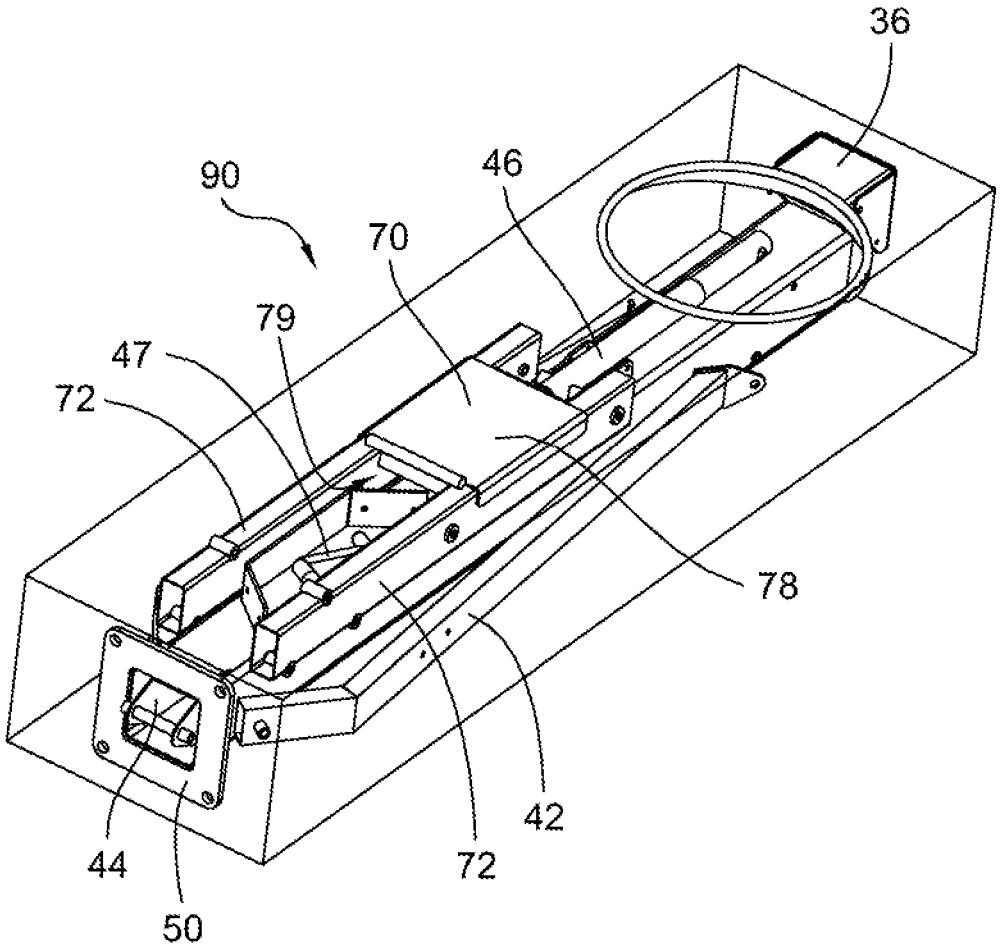
FIG. 8 is a perspective view of portions of the basketball goal assembly of FIG. 1 in a positioned within a shipping container.

In certain embodiments, the components of goal assembly 10 can, in a preassembled state, be packaged in a container in a manner which facilitates shipping, storage, delivery and installation. An example is illustrated in FIG. 8. FIG. 8 illustrates a packing container 90, shown in a transparent form for ease of illustration. Packing container 90 is sized and shaped to hold the components of basketball goal assembly 10, with the exception of backboard 34 which may be shipped separately for example in a flat container. The lower support assembly 50 is arranged longitudinally in a central flat position within container 90.

In certain embodiments, support arms such as lower support arm 44 can be stored inside the hollow interior of lower assembly 50. Generally, the lower pole section will be at least as long if not longer than the lower support arm 44. Upper support assembly 70 is arranged longitudinally over lower support assembly 50 within container 90. As illustrated in FIG. 6, bracket plate 78 is offset to one side of the side bars 72. When placed in container 90, upper assembly 70 is placed with the bracket offset on the upper side. This creates a nest area 79 as a volume below bracket plate 78 and between side bars 72. In certain embodiments components of goal assembly 10 such as cylinder 46 and handle 47 are packed over the lower support assembly and extend through the nest area 79. In other arrangements, components of the support structure or backboard frame can be packed to extend through nest area 79. In still other embodiments, the pole section of lower support assembly 50 is received in nest area 79 for all or a portion of the nest depth. Side bars 72 are spaced apart a sufficient distance to allow the lower pole section to be received between them, allowing the side bars and pole section to overlap in height within container 90. Various packing materials such as cardboard, plastic, foam, pious, sealed air pockets or the like can be used between and around the components during shipment to minimize movement, direct contact and potential damage to the components while in container 90.

Preferably, container 90 is compact, with minimal height, length and width, thus requiring reduced space during shipment and storage. Optionally, the container may be sized to be placed completely in the cargo area of and transported by a consumer passenger vehicle such as a pick-up truck, SUV or car. As an example, the length of container 90 is the longest dimension and may be less than 96". More preferably, the length may be less than 78", corresponding to the height of lower support assembly 50 plus the thickness of packing materials. The height or thickness may be relatively short such as less than 10" or more preferably less than 6", such as approximately 5". As representative examples, a vertical support assembly for a 72" backboard sized goal may be packaged in a container with dimensions of 75"×43"×5" with a total weight of 250.6 lbs. In another example, a vertical support assembly for a 63" backboard sized goal may be packaged in a container with dimensions of 63"×41"×5" with a total weight of 244 lbs., and a vertical support assembly for a 54" backboard sized goal may be packaged in a container with dimensions of 57"×41"×5" with a total weight of 217.2 lbs.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected. Dimensions are not intended to be limiting and may be altered as would be understood by one of ordinary skill in the art.

What is claimed is:

1. A basketball goal assembly, comprising:

a lower support assembly including a pole section having opposed, spaced-apart sides defining a hollow interior therebetween, each side having an inner surface and an outer surface, the pole section further including a plurality of mounting tubes extending between the sides, each mounting tube having a hollow interior and having first and second open ends, said lower support assembly having a lower end supported by a support surface;

an upper support assembly including a pair of spaced-apart, parallel side bars connected by a bracket, the pole section being received between the side bars, each side bar including an inward surface facing a respective outer surface of the sides of the pole section, each side bar including a plurality of hollow bushings, the bushings on one side bar being aligned with and positioned adjacent to the first ends of respective mounting tubes, the bushings on the other side bar being aligned with and positioned adjacent to the second ends of respective mounting tubes, the respective bushings and mounting tubes defining a through passageway for reception of fasteners, the respective bushings and adjacent mounting tubes forming gaps spacing apart the inward surfaces of the side bars from the outer surfaces of the pole section, said upper support assembly further including at least one support arm mounted to said side bars and supporting a backboard assembly; and a plurality of fasteners securing the pole section with the side bars, each fastener extending through the passageway of the aligned bushings and mounting tubes to secure the bushings adjacent to the ends of the mounting tubes.

2. The basketball goal assembly of claim 1, wherein the ends of said mounting tubes protrude from said pole section of the respective mounting tubes, and define the gap spacing the side bar inward surfaces apart from said pole section sides.

3. The basketball goal assembly of claim 1, wherein said mounting tubes are parallel and offset in a triangular arrangement.

4. The basketball goal assembly of claim 1, wherein each of said fasteners is matched to a respective one of said mounting tubes, wherein each fastener defines a length between a proximal end and a distal end, with the distal end engaging a bushing on one side bar, and the proximal end engaging a bushing on the other side bar and the length extending through the mounting tube.

5. The basketball goal assembly of claim 1, wherein one end of each fastener is threaded and engages a threaded portion of a respective bushing.

6. The basketball goal of claim 1, wherein the spaced apart parallel side bars are connected by said bracket placed rearward of a plane defined by the central longitudinal axes of said side bars.

7. The basketball goal of claim 6, wherein said bracket is assembled to the rearward sides of said side bars.

8. The basketball goal of claim 6, wherein said bracket comprises a planar plate spanning the rear sides of said side bars and the distance separating them.

9. The basketball goal of claim 6, wherein said bracket is welded to said sidebars.

10. The basketball goal assembly of claim 1, wherein said backboard assembly is supported by support arms extending between and pivotally mounted to said side bars and said backboard assembly forms a parallelogram arrangement which is deformable to adjust the height of said backboard assembly, and wherein at least one of said support arms extends through a gap defined between said bracket and an upper end of said pole section such that said bracket forms a stop limiting rotational movement of said support arms.

11. The basketball goal assembly of claim 10, wherein said upper end of said pole section forms a stop limiting rotational movement of said support arms.

12. The basketball goal assembly of claim 1, wherein the bushings are welded to said side bars.

13. A basketball goal assembly, comprising:

a. a vertical support assembly having a lower end, said vertical support assembly formed with a lower support assembly and an upper support assembly;

b. a backboard assembly;

c. support arms pivotally mounted to said upper support assembly and secured to said backboard assembly, said upper support assembly, support arms and backboard assembly forming a parallelogram arrangement which is deformable to adjust the height of said backboard assembly;

d. said lower support assembly having a hollow pole section defining opposing sides, the pole section further including a plurality of mounting tubes extending between the sides, each mounting tube having a hollow interior and having first and second open ends;

e. said upper support assembly including a pair of spaced apart parallel side bars connected by a bracket;

f. wherein said side bars are arranged on opposing sides of said pole section, each side bar having an inward surface, each side bar including a plurality of bushings, the bushings on one side bar being aligned with and positioned adjacent to the first ends of respective mounting tubes, the bushings on the other side bar being aligned with and positioned adjacent to the second ends of respective mounting tubes, the respective bushings and mounting tubes defining a through passageway for reception of fasteners, the respective bushings and adjacent mounting tubes forming gaps spacing apart the inward surfaces of the side bars from the pole section;

g. wherein lower ends of said side bars overlap with the upper end of said pole section, wherein said upper support assembly is secured to said lower support assembly; and, h. wherein side edges of said bracket are bent to form flanges extending forward along the sides of said side bars and wherein upper and lower edges of said bracket are bent forward between said side bars.

* * * * *